US005321898A

United States Patent [19]

Robinette, Jr. et al.

[11] Patent Number: 5,321,898

[45] Date of Patent: Jun. 21, 1994

[54] CENTRIFUGAL SCREEN BOWL DRYER

[75] Inventors: Kenneth Robinette, Jr., Jonesborough, Tenn.; Ron Jahnig, Huntington, W. Va.; Larry Lovegrove, Bluff City, Tenn.

[73] Assignee: Decanter Machine, Inc., Johnson City, Tenn.

[21] Appl. No.: 901,391

[22] Filed: Jun. 19, 1992

[51] Int. Cl.[5] ..... F26B 17/28

[52] U.S. Cl. ..... 34/58; 210/360.1; 494/53; 494/54; 34/182

[58] Field of Search ..... 34/58, 181-182, 34/184, 236, 60, 8; 494/36, 53, 54, 55, 58; 210/403, 360.1, 374, 377

[56] References Cited

U.S. PATENT DOCUMENTS

| | | | |
|---|---|---|---|
| 1,016,870 | 2/1912 | Berrigan | 494/26 |
| 1,478,660 | 12/1923 | Barnes et al. | 210/377 |
| 3,246,404 | 4/1966 | O'Conor | 34/58 |
| 4,190,194 | 2/1980 | Amero | 233/7 |
| 4,202,773 | 5/1980 | Fink et al. | 210/403 |
| 4,368,125 | 1/1983 | Murray | 210/403 |
| 4,541,929 | 9/1985 | Janusch | 210/374 |
| 4,731,182 | 3/1988 | High | 210/374 |
| 5,068,979 | 12/1991 | Wireman et al. | 34/58 |

FOREIGN PATENT DOCUMENTS

| | | |
|---|---|---|
| 0188125 | 10/1984 | Japan . |
| 1483216 | 5/1989 | U.S.S.R. . |

OTHER PUBLICATIONS

Brochure of Decanter Machine, Inc. having page therein entitled *Typical Decanter Machine Screenbowl Centrifuge.*

Brochure entitled *Typical Decanter Machine Solid Bowl Centrifuge.*

*Primary Examiner*—Denise Gromada

*Attorney, Agent, or Firm*—Luedeka, Hodges, Neely & Grahm

[57] ABSTRACT

Rotary dryer having an enclosure surrounding a plurality of elongate blades positioned along an exterior portion of a fluid permeable sidewall. Rotation of the blades within the enclosure induces air to pass through the sidewall to improve drying characteristics of the dryer.

8 Claims, 5 Drawing Sheets

CENTRIFUGAL SCREEN BOWL DRYER

TECHNICAL FIELD

The present invention relates in general to centrifugal screen bowl dryers for separating solids from liquid and for drying the separated solids. More particularly, the present invention relates to a centrifugal screen bowl dryer of the type having a rotating screen, wherein a portion of the rotating screen acts as a centrifugal blower to improve drying of the separated solids.

BACKGROUND OF INVENTION

Horizontal centrifuges are commonly used to dewater and dry a variety of materials. Their applications include coal, chemical, food processing, paper mills, drilling reclamation, and sewage treatment plants.

Screen bowl dryers are horizontal centrifuges which incorporate a cylindrical slotted screen to dry solids. Typical screen bowl dryers include a bowl and a helically bladed or screw conveyor. The bowl and conveyor are rotated about a common axis in the same direction but at different speeds to discharge solids which have been separated from a slurry. The solids are discharged through a conical end of the bowl having a reduced diameter. The larger diameter section of the bowl is typically solid and the reduced diameter section is provided by the slotted screen. The slurry is introduced into the solid section of the bowl and solids are centrifugally separated from liquid. Separated solids are conveyed by the screw conveyor across the rotating screen for drying. The dried solids are then discharged.

Because the value of the dried material is dependent upon its dryness, it is desirable to improve drying characteristics of screen bowl dryers. The present invention relates to an improved screen bowl dryer which, in a cost effective manner, lowers the moisture content of the exiting material to increase the value of the material.

SUMMARY OF THE INVENTION

The present invention relates to an improved screen bowl dryer wherein a portion of the rotating screen includes blades affixed to the outside of the screen. Rotation of the screen, and hence the blades, inside a housing creates a negative pressure to pull air from the interior of the screen. As the air passes through the screen and the solids contained by the screen, moisture is removed with the air and discharged from the dryer. The air flow thus removes moisture beyond that removed by centrifugal force alone and thereby provides a product having reduced moisture content.

Generally described, the present invention provides a rotary drying device for removing liquid and moisture from a slurry composed of solids and fluid. The drying device comprises a housing; a rotatable enclosure within the housing having a separating section adjacent an entrance end of the enclosure for removing solids from liquid to provide separated solids and a drying section adjacent an exit end of the enclosure for removing moisture from the separated solids, the drying section having a fluid permeable sidewall; means for conveying separated solids from the separating section through the drying section for removal of moisture from separated solids to provide dried solids; means for admitting air into the drying section; a plurality of elongate blades positioned along an exterior portion of the fluid permeable sidewall for inducing air within the drying section to pass through the sidewall in response to rotation of the enclosure within the housing; and means for withdrawing the dried solids from the enclosure.

More particularly, the present invention provides a rotary drying device for removing liquid and moisture from a slurry composed of solids, fines and liquid. The drying device comprises a housing; an enclosure mounted for rotation within the housing; inlet means for introducing the slurry into the enclosure; a solid enclosure portion formed in the enclosure for being rotated to centrifugally separate liquid from solids and fines; an outlet disposed adjacent the solid enclosure portion for releasing liquid from the solid enclosure portion; a first screen portion formed in the enclosure adjacent the solid enclosure portion; a plurality of first openings formed in the first screen portion and being dimensioned to allow liquid and some fines to pass through the first openings and to prevent solids from passing therethrough, whereby liquid and some fines are centrifugally forced through the first openings as the enclosure rotates; a first screen discharge for receiving and discharging liquid and fines that pass through the first openings; a second screen portion formed in the enclosure adjacent the first screen portion; a plurality of second openings formed in the second screen portion and being dimensioned to allow at least moisture and air to pass through the openings; a second screen discharge for receiving at least moisture that passes through the second openings; a chamber formed as part of the second screen discharge and being disposed around the second screen portion for substantially aeromechanically isolating the exterior of the second screen portion; vent means for venting air into at least the second screen portion; fan means for inducing a negative air pressure within the chamber relative to air pressure within the second screen portion in response to rotation of said enclosure, whereby air is drawn through the second openings; a product discharge disposed adjacent the second screen portion on the opposite side thereof from the first screen portion; and a conveyor for moving slurry through the solid enclosure portion, through the first screen portion and through the second screen portion to the product discharge, whereby air moves through the vent means, through the slurry in the second screen portion picking up moisture and drying the slurry, through the second openings and into the second screen discharge.

Accordingly, it is an object of the present invention to provide an improved rotary drying device.

Another object of the present invention is to provide an improved screen bowl dryer.

A further object of the present invention is to provide a screen bowl dryer which induces air to pass through the screen to improve drying characteristics of the dryer, preferably, by the provision of blades on the screen acting as a centrifugal fan.

These and other objects, features and advantages of the present invention will become apparent from a review of the following detailed description of preferred embodiment and the appended drawings and claims.

DETAILED DESCRIPTION OF PREFERRED EMBODIMENT

Figure 1:
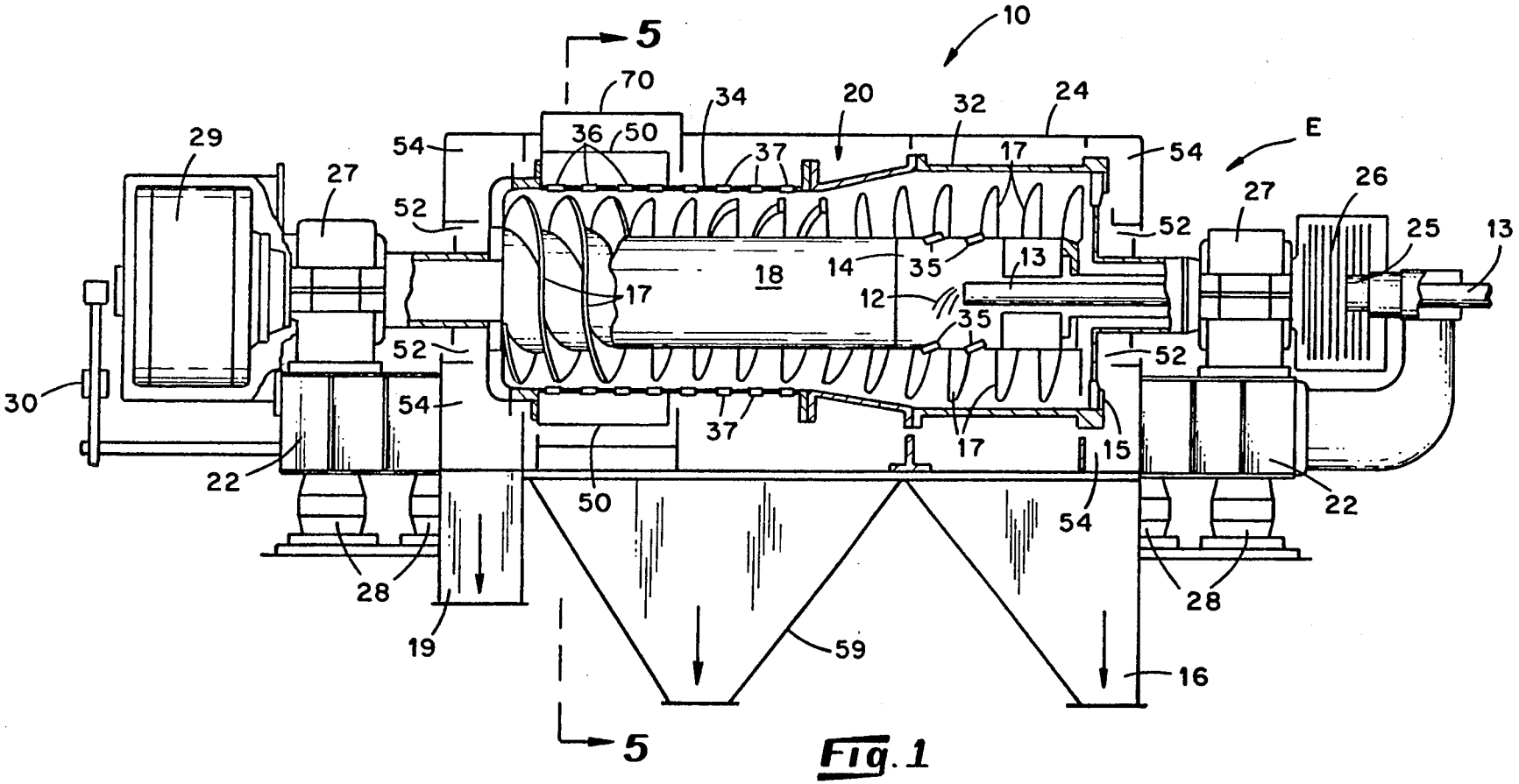
FIG. 1 is a cross-sectional side view of a preferred embodiment of the dryer of the present invention.

Referring to the drawings, in which like reference characters indicate like parts throughout the several views, FIG. 1 shows a centrifugal screen bowl dryer 10. A slurry 12 is fed by a feed pipe 13 from a slurry source (not shown) for delivery into a feed compartment 14 located at an entrance end E of the dryer 10. Typically, the slurry 12 is a fluidized mixture of solids, such as coal, and liquids, such as water, having between about 20 and 60% by weight solids. The dryer 10 centrifugally separates solids from the slurry 12. The removed liquid slurry components spill over an annular wall 15 and are discharged via a discharge port 16. The removed solid components are conveyed by helical blades 17 of a conventional screw conveyor 18 through the dryer 10 for drying of the solids. The dried solids provided by the present invention have less moisture and are discharged through a product discharge port 19. In this manner, the improved construction of the dryer of the present invention provides enhanced drying of solids over conventional screen bowl dryers.

Figure 2:
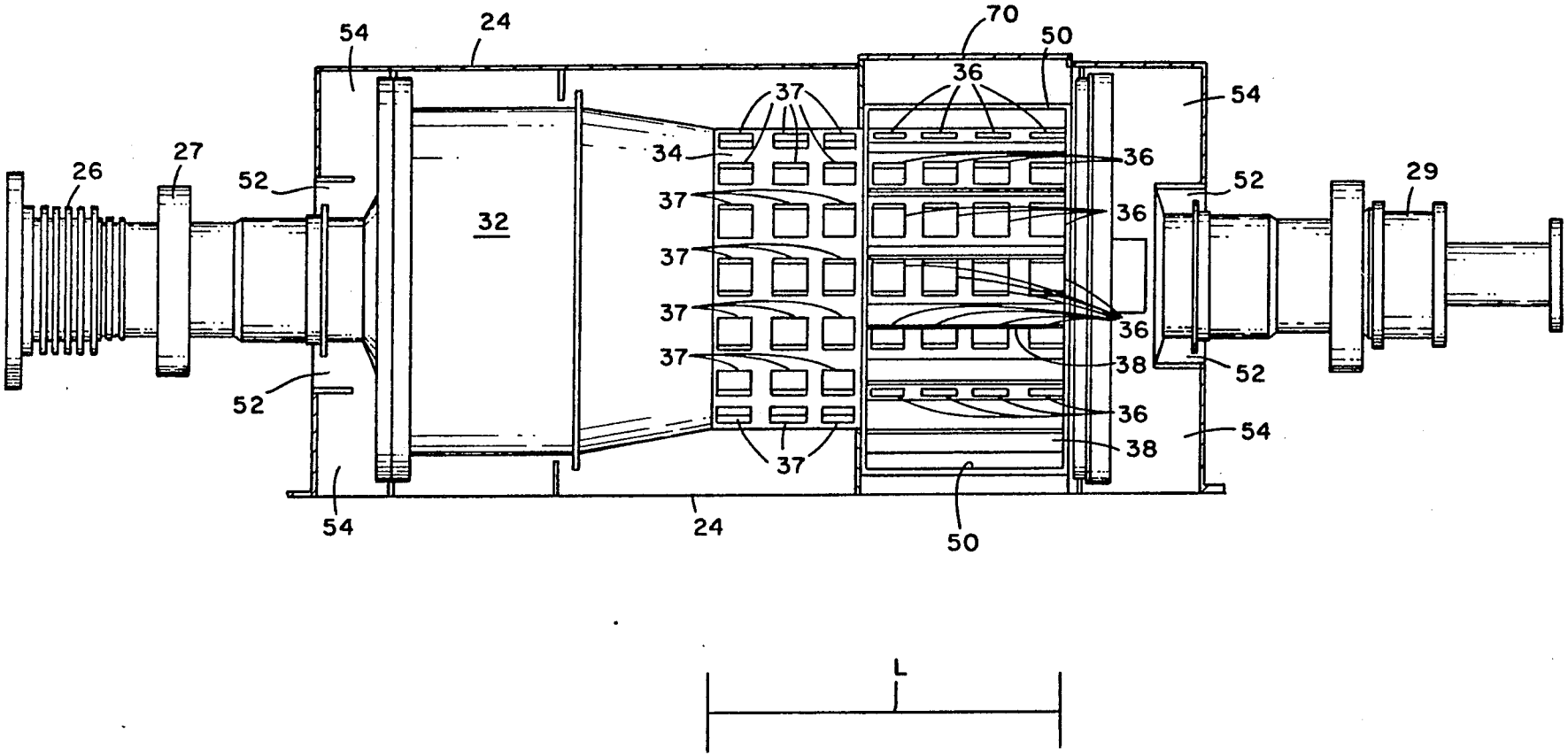
FIG. 2 is a side view of a screen bowl utilized in the dryer FIG. 1.

Referring now to FIGS. 1 and 2, the dryer 10 includes an elongate screen bowl 20 rotatably mounted on a support frame 22 and enclosed within a housing 24. The support frame 22 includes thrust bearings 25, drive sheave 26, main bearings 27 vibration isolators 28, planetary gearbox 29, and torque sensor 30.

Figure 3:
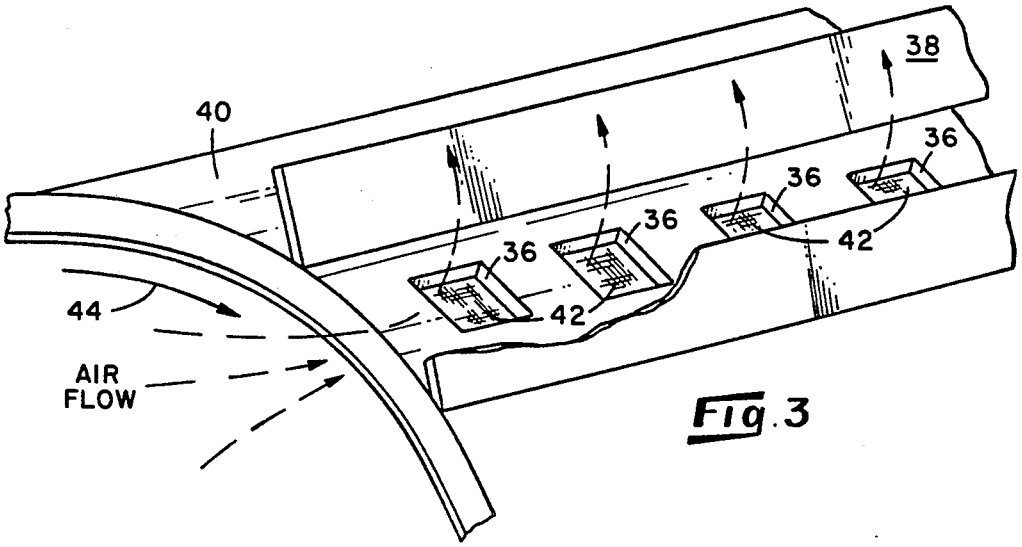
FIG. 3 is a close-up sectional view of the screen utilized in the dryer of the present invention.
Figure 4:
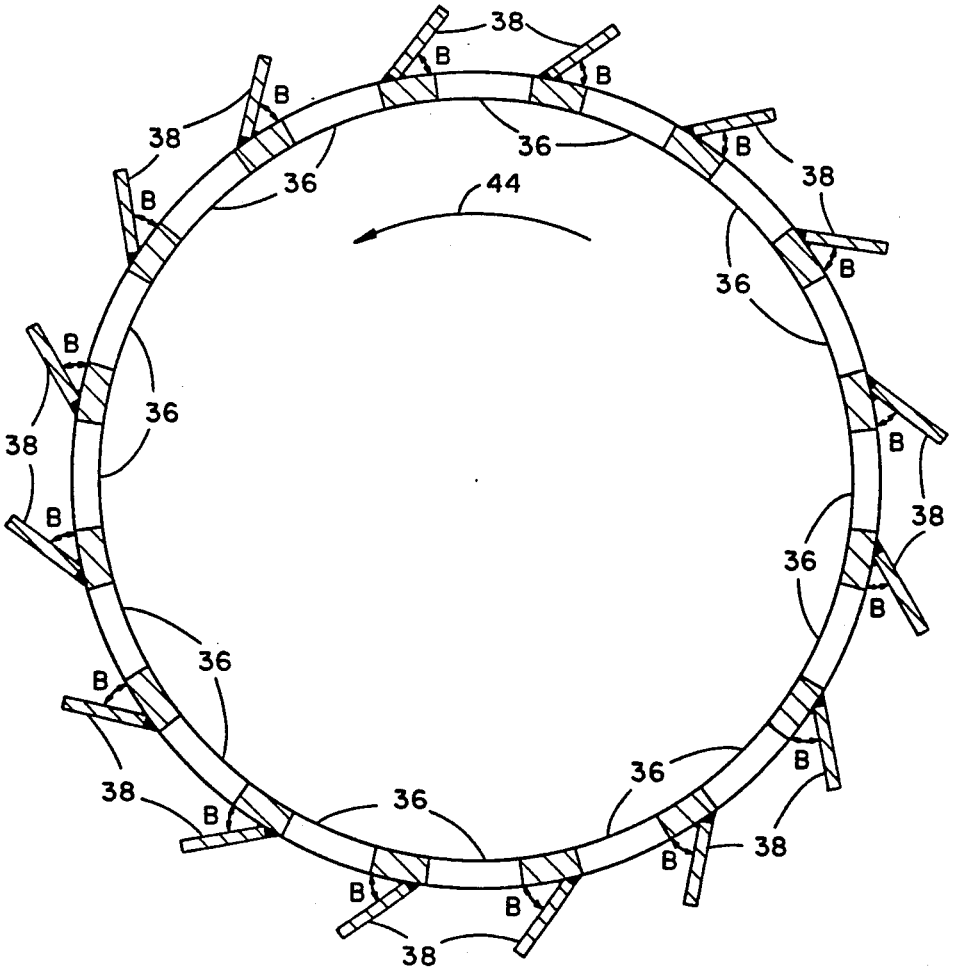
FIG. 4 is a cross-sectional end view of the screen bowl utilized in the dryer of FIG. 1.

With further reference to FIGS. 1 and 2, the screen bowl 20 includes a solid, cylindrical bowl 32 and a cylindrical slotted screen 34, the slotted screen 34 having a length "L". A suitable bowl 32 and slotted screen 34 is that utilized in the screen bowl dryer available from Decanter Machine, Inc. of Johnson City, Tenn. the assignee of the present invention. Slurry flows from the feed compartment 14 through openings 35 into the solid bowl 32 for centrifugal separation of solids from liquid in the bowl 32. The solids move toward the outside of bowl 32 due to centrifugal force and the liquids are displaced by the solids and move toward the center of bowl 32. As more slurry 12 is added, the rising liquid spills over the annular wall 15 and is discharged through discharge port 16. The solids are conveyed by the blades 17 of the screw conveyor 18 to and through the slotted screen 34 for drying of the solids. The slotted screen 34 includes a plurality of uniformly spaced openings 36 and 37 along the length of the slotted screen 34 through which moisture is removed, as described more fully below. In accordance with the present invention, a plurality of uniformly spaced apart air blades 38 are longitudinally affixed to a portion 40 of the outside surface of the slotted screen 34 such that they straddle the openings 36, as best shown in FIGS. 3 and 4, to act as a "centrifugal blower" to induce air to pass through the openings 36 for enhanced removal of moisture. As can be seen in FIG. 3, an aperture screen 42 is provided within each opening 36. Aperture screens for use with coal slurries are typically of ceramic construction and are typically 2 inches square or are 2 inch diameter circles and have slotted screen apertures of between about 0.020 to about 0.025 inch. It will be understood, however, that the aperture screens may be otherwise dimensioned for various applications. Each opening 37 likewise includes an aperture screen 42.

With further reference to FIGS. 3 and 4, the blades 38 are affixed, such as by welding, to the outside surface 40 such that they are inclined at an angle B relative to the surface 40 away or backwards to the direction of rotation of the screen as indicated by the arrow 44. The angle of inclination B of each blade 38 is preferably about 45°. For a typical slotted screen having a circumference of about 100 inches and a length of about 24 inches, thirty-one of the blades 38 are utilized and are uniformly spaced apart about 3¼ inches, each blade preferably having a width of about 2½ inches, a length of about 13 inches, and a thickness of about ¼ inch. The blades 38 are positioned to straddle the openings 36 to allow air to be pulled through the aperture screens 42, as will be explained more fully below. The blades 38 are preferably backward inclined for ease of construction and to provide higher efficiency and superior discharge. The blades 38 are also preferably constructed of materials having a high resistance to wear, and the faces of the blades are preferably lined with a wear compound such as ceramics when the material to be dried has high abrasive characteristics. The surface 40 to which the blades are affixed preferably represents about the last 50 to 75 percent of the length L of the slotted screen 34. The blades are provided at this location because the majority of drying attributable to centrifugal force occurs across about the first 25 percent of the slotted screen. Therefore, the blades are added after the first 25 percent of the slotted screen so that the "centrifugal blower" provided by the blades does not have to handle moisture normally expelled by centrifugal force and the associated fines which are normally discharged through the aperture screens.

Figure 5:
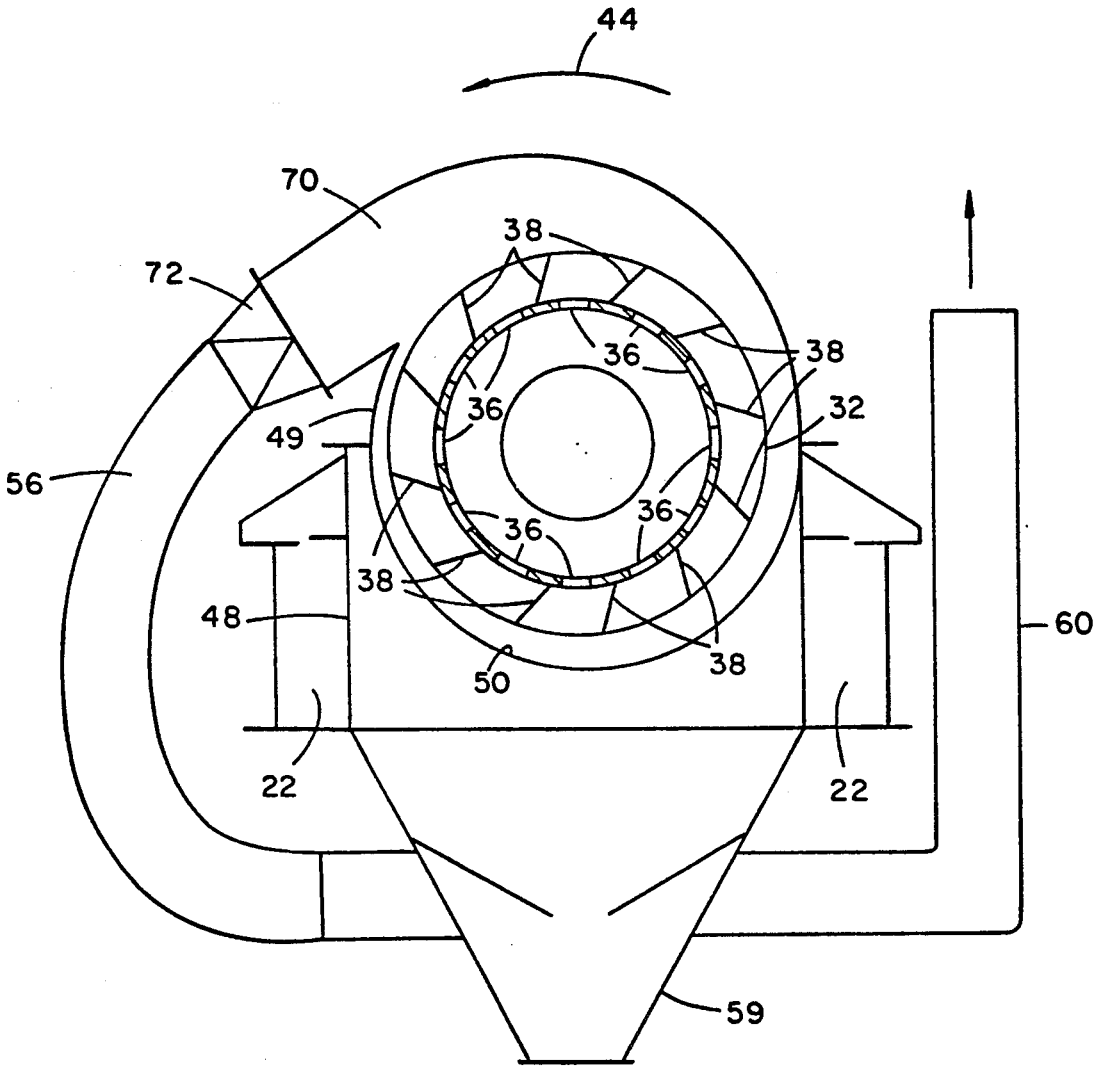
FIG. 5 is a cross-sectional end view taken along line 5—5 of the dryer shown in FIG. 1.
Figure 6:
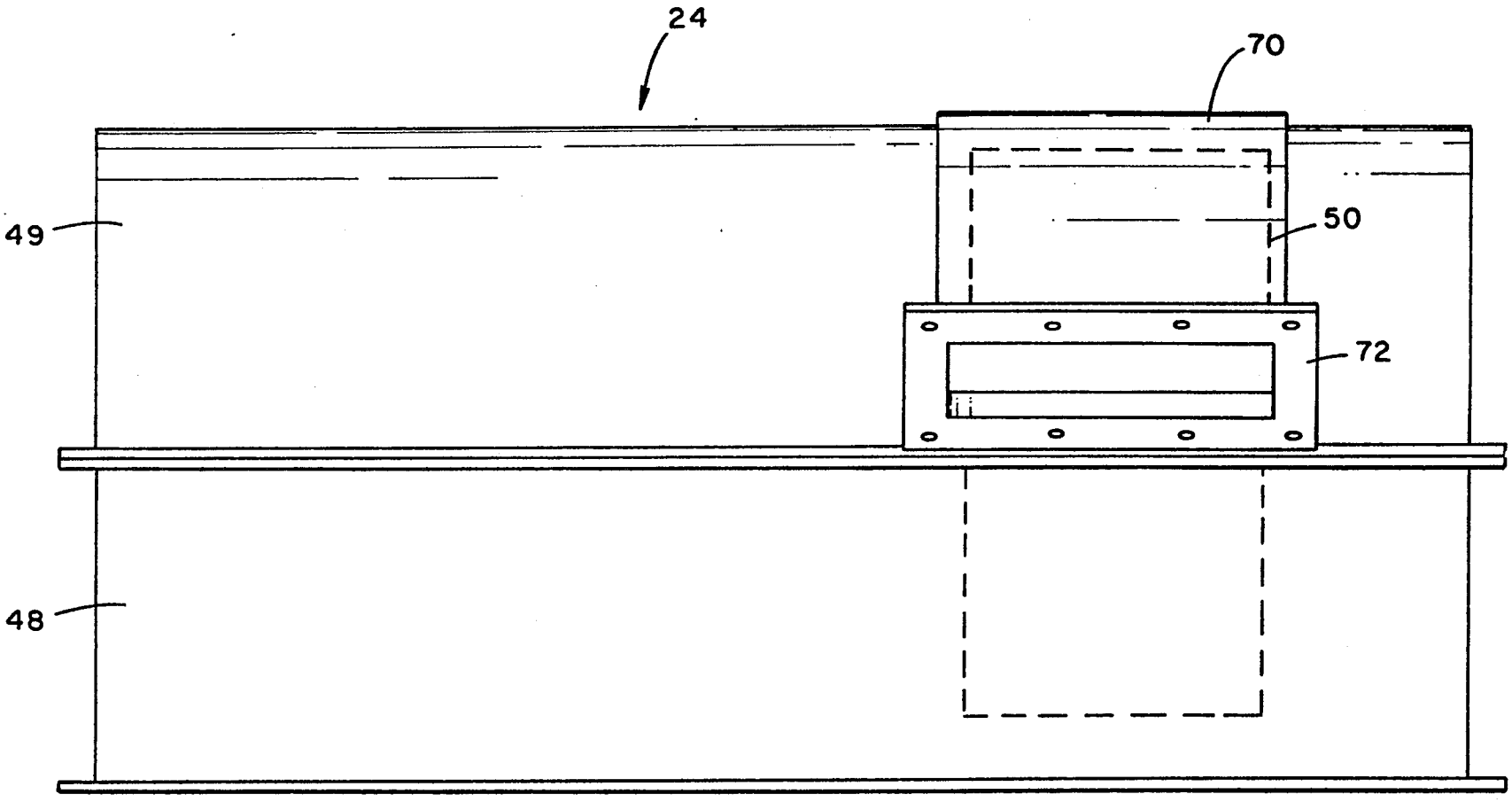
FIG. 6 is a side elevational view of the housing utilized in the dryer of FIG. 1.

The housing 24, best shown in FIGS. 5 and 6, includes features which have been added to cooperate with the blades to provide the "centrifugal blower" advantages to the dryer. Particularly, the housing 24 includes a lower section 48, an upper section 49, and a reduced diameter scroll housing 50 within the housing 24 positioned to surround the blades 38. Rotation of the blades 38 within the scroll housing 50 during operation of the dryer creates a negative pressure adjacent the slotted screen 34 which pulls air out of the slotted screen through the openings 36 and provides the "centrifugal blower" feature of the present invention. Ambient air is introduced into the interior of the slotted screen through vents 52 provided at each end of the housing 24. Additionally, each end of the housing 24 is enlarged about the centerline of the slotted screen 34 to provide open areas 54 which are in communication with the vents 52 to permit air to enter the screen 34. Discharge air from the scroll housing 50 is directed by a conduit 56 into a screen discharge hopper 59 for discharge of moisture and fines extracted by the "centrifugal blower". Optionally, discharged air may be vented to the atmosphere via a discharge vent 60.

With further reference to FIGS. 5 and 6, the scroll housing 50 has a diameter which is smaller than that of the upper section 49 and lower section 48 of the housing 24 and is preferably sized such that clearance between the blades and the interior surface of the scroll housing and rotation of the blades within the housing provides a pressure drop of about 5–8 in. Hg. through the openings 36. An enlarged discharge cowling 70 is provided on the upper section 49 of the housing 24 adjacent the scroll housing 50, as shown in FIG. 5, to direct the air flow generated by the rotation of the blades 38 within the scroll housing 50 toward the conduit 56. A flange 72 is provided on the outlet end of the discharge cowling 70 and connects the cowling 70 to the conduit 56 for discharge of moisture and fines extracted by the "centrifugal blower".

The dryer 10 operates as follows. A continuous supply of slurry is introduced into the feed compartment 1 by the feed pipe 13. The screen bowl 20 and the conveyor 18 are rotated in the same direction about a common axis at different speeds. The conveyor 18 preferably rotates at a rate of between about 875 and 1170 rpm, such that the solids travel at a rate of between about 25 and 30 ft/min through the dryer. The bowl 20 preferably rotates at a rate of between about 900 and 1200 rpm. Solids are centrifugally separated from liquid in the solid bowl 32 and the liquid is discharged through the discharge port 16. The solids are conveyed from the bowl 32 by the blades 17 of the conveyor 18 through the slotted screen 34 of the screen bowl 20 for drying. Rotation of the slotted screen 34 centrifugally removes moisture from the solids as they are conveyed past the openings 37, the moisture being centrifugally forced through the screens 42 in the openings 37 and thereafter discharged from the dryer. Ambient air introduced into the slotted screen 34 via the vents 52 and open areas 54 enters the interior of the slotted screen 34 and is pulled through the solids and the aperture screens 42 in the openings 36 by the negative pressure created by rotation of the blades 38 within the scroll housing 50. Passage of the air through the solids adjacent the openings 36 extracts moisture from the solids in addition to that which is removed by centrifugal force alone and thereby provides enhanced removal of moisture from the solids. The air, extracted moisture, and associated fines are discharged by the cowling 70 for routing to the screen discharge hopper 59. The dried solids are removed from the dryer via the product discharge port 19.

Dried solids provided by conventional dryers typically have a moisture content of between about 16 and 20%. Dried solids provided by dryers made in accordance with the present invention have a lower moisture content than those dried conventionally. For example, dried solids having a moisture content of between about 13 and 17% have been provided in accordance with the present invention.

The foregoing description relates to a preferred embodiment of the present invention, and modifications or alterations may be made without departing from the spirit and scope of the invention as defined in the following claims.

What is claimed is:

1. A rotary drying device for removing liquid and moisture from a slurry composed of solids, fines and liquid, said drying device comprising:

a housing;

an enclosure mounted for rotation within said housing;

inlet means for introducing the slurry into said enclosure;

a solid enclosure portion formed in said enclosure for being rotated to centrifugally separate liquid from solids and fines;

an outlet disposed adjacent said solid enclosure portion for releasing liquid from said solid enclosure portion;

a first screen portion formed in said enclosure adjacent said solid enclosure portion;

a plurality of first openings formed in said first screen portion and being dimensioned to allow liquid and some fines to pass through said first openings and to prevent solids from passing therethrough, whereby liquid and some fines are centrifugally forced through said first openings as said enclosure rotates;

a first screen discharge for receiving and discharging liquid and fines that pass through said first openings;

a second screen portion formed in said enclosure adjacent said first screen portion;

a plurality of second openings formed in said second screen portion and being dimensioned to allow at least moisture and air to pass through said openings;

a second screen discharge for receiving at least moisture that passes through said second openings;

a chamber formed as part of said second screen discharge and being disposed around said second screen portion for substantially aeromechanically isolating the exterior of said second screen portion;

vent means for venting air into at least said second screen portion;

fan means for inducing a negative air pressure within said chamber relative to air pressure within said second screen portion in response to rotation of said enclosure, whereby air is drawn through said second openings;

a product discharge disposed adjacent said second screen portion on the opposite side thereof from said first screen portion; and a conveyor for moving slurry through said solid enclosure portion, through said first screen portion and through said second screen portion to said product discharge, whereby air moves through said vent means, through the slurry in said second screen portion picking up moisture and drying the slurry, through said second openings and into said second screen discharge.

2. The device of claim 1 wherein:

said fan means comprises a plurality of blades mounted on the exterior of said second screen portion; and said chamber forms an expanding scroll chamber around said blades, whereby said blades and chamber together form a centrifugal fan.

3. A rotary drying device for removing liquid and moisture from a slurry composed of solids and fluid, said drying device comprising:

a housing;

a rotatable enclosure within the housing having a separating section adjacent an entrance end of the enclosure for removing solids from liquid to provide separated solids and a drying section adjacent an exit end of the enclosure for removing moisture from the separated solids, said drying section having a fluid permeable sidewall;

means for introducing the slurry into the entrance end of the enclosure;

means for conveying separated solids from the separating section through the drying section for removal of moisture from separated solids to provide dried solids;

means for admitting air into the drying section;

means for creating a negative pressure adjacent the fluid permeable sidewall sufficient to pull air present in the interior of the enclosure out of the interior of the enclosure through the sidewall in response to rotation of the enclosure within the housing, said means for creating a negative pressure comprising a plurality of elongate blades positioned along an exterior portion of the fluid permeable sidewall for inducing air within the drying section to pass out of the drying section through the sidewall in response to rotation of the enclosure within the housing; and means for withdrawing the dried solids from the enclosure.

4. The rotary drying device of claim 3, wherein said rotatable enclosure comprises a screen bowl.

5. The rotary drying device of claim 4, wherein said separating section comprises a solid portion of said screen bowl and said drying section comprises a slotted section of said screen bowl.

6. The rotary drying device of claim 3, wherein said means for conveying comprises a screw conveyor.

7. The rotary drying device of claim 3, wherein said means for admitting air comprises a plurality of vents defined in said housing and in communication with a plurality of passages extending from said vents to said drying zone.

8. The rotary drying device of claim 3, wherein said fluid permeable sidewall comprises a sidewall having a plurality of openings defined therein, each of said openings having a screen positioned therein.

* * * * *